US005323755A

United States Patent [19]

Hsieh

[11] Patent Number: 5,323,755

[45] Date of Patent: Jun. 28, 1994

[54] TOY GUN

[76] Inventor: Yin-Wang Hsieh, No. 91, Yu Ming Street, Pan Chiao City, Taipei Hsien, Taiwan

[21] Appl. No.: 942,805

[22] Filed: Sep. 10, 1992

[51] Int. Cl.[5] ..... F41B 11/14; F41B 11/18

[52] U.S. Cl. ..... 124/66; 124/59

[58] Field of Search ..... 124/16, 26, 27, 45, 124/48, 56, 65–67, 59

[56] References Cited

U.S. PATENT DOCUMENTS

| | | | |
|---|---|---|---|
| 2,194,142 | 3/1940 | Foss | 124/67 |
| 2,237,678 | 4/1941 | Lohr et al. | 124/66 |
| 3,774,586 | 11/1973 | Saito | 124/48 X |
| 4,367,723 | 1/1983 | Resuggan | 124/67 |
| 4,848,307 | 7/1989 | Tsao | 124/59 |
| 4,883,042 | 11/1989 | Wackrow | 124/67 |

FOREIGN PATENT DOCUMENTS

| | | | |
|---|---|---|---|
| 2313631 | 10/1974 | Fed. Rep. of Germany | 124/67 |
| 480612 | 5/1953 | Italy | 124/67 |
| 483899 | 4/1938 | United Kingdom | 124/67 |

*Primary Examiner*—Randolph A. Reese
*Assistant Examiner*—John Ricci
*Attorney, Agent, or Firm*—Varndell Legal Group

[57] ABSTRACT

A toy gun, mainly comprising a dart loading chamber and a gun body, wherein inside the gun body there are provided an air compression tube, a cocking mechanism, a trigger, a variety of springs and a screw shaft with a turning device in the front. The turning device is arranged in the rotary wheel which is molded integrally with the exhaust tubes and enclosed outside by a shell to form a dart loading chamber. By means of the ratchet teeth of the rotary wheel, the turning device unidirectionally rotates the rotary wheel. After loading darts, the compressed air generated in the air compression tube tosses darts from the dart loading chamber.

5 Claims, 5 Drawing Sheets

TOY GUN

FIELD OF THE INVENTION

The present invention generally relates to a toy gun, and more particularly to a toy gun having a gun body with an air compression and rotary wheel mechanism which tosses a projectile by means of the combination of a mechanical apparatus and springs, and which does not require an electrical motor driving device.

BACKGROUND OF THE INVENTION

A toy not only provides amusement to the player but also has the efficacy of enlightenment. Thus, the usage of a toy is an aid to the player for a sequential operation and response training. Currently many toys imitating realities make people confused in telling the difference, which produces a negative effect. These techniques used in conventional toy guns and their shortcomings are illustrated below.

1. Toy guns energized by batteries and driving motors, comprising a motor driven gear train which simulates various actions such as the firing noise of a machine gun, rotation shocks, etc., whose deficiencies consist in the limited lifetime of batteries and the battery oxidization caused by not using the toy gun for a long time which can damage it.

2. Toy water guns with a simple construction, mainly using pressurized water to create a water ejection, lack of interest being their deficiency.

3. BB guns using plastic bullets as projectiles and carbon dioxide or gas as energy sources which have lifelike configurations and are the currently prevailing games. However, high danger is there shortcomings, beside which, they might be used by bandits as a criminal tool.

OBJECT OF THE INVENTION

It is the general object of the present invention to provide a toy gun, in which the shortcomings described heretofore have been eliminated.

Another object of the present invention is to provide a more safe toy gun with simplified construction.

It is another object of the present invention to promote the interest of toy guns and exhibit their positive meaning and great value by employing special mechanical apparatuses and air compression means.

To accomplish the foregoing objects, the present invention proposes a toy gun employing the physical properties of springs to move the piston, compress air, and toss projectiles; in which the screw threads of the rotary wheel enable loading projectiles during air compression. Other objects and features of the present invention will be apparent in the following detailed description of an illustrated preferred embodiment which is to be read in conjunction with the accompanying drawings.

BRIEF DESCRIPTION OF THE DRAWINGS

FIG. 4A shows a loading shell, FIG. 4B shows the exhaust tubes and rotary wheel onto which the loading shell can be secured and FIG. 4C is a cross-sectional view of the rotary wheel.

DETAILED DESCRIPTION

Figure 1:
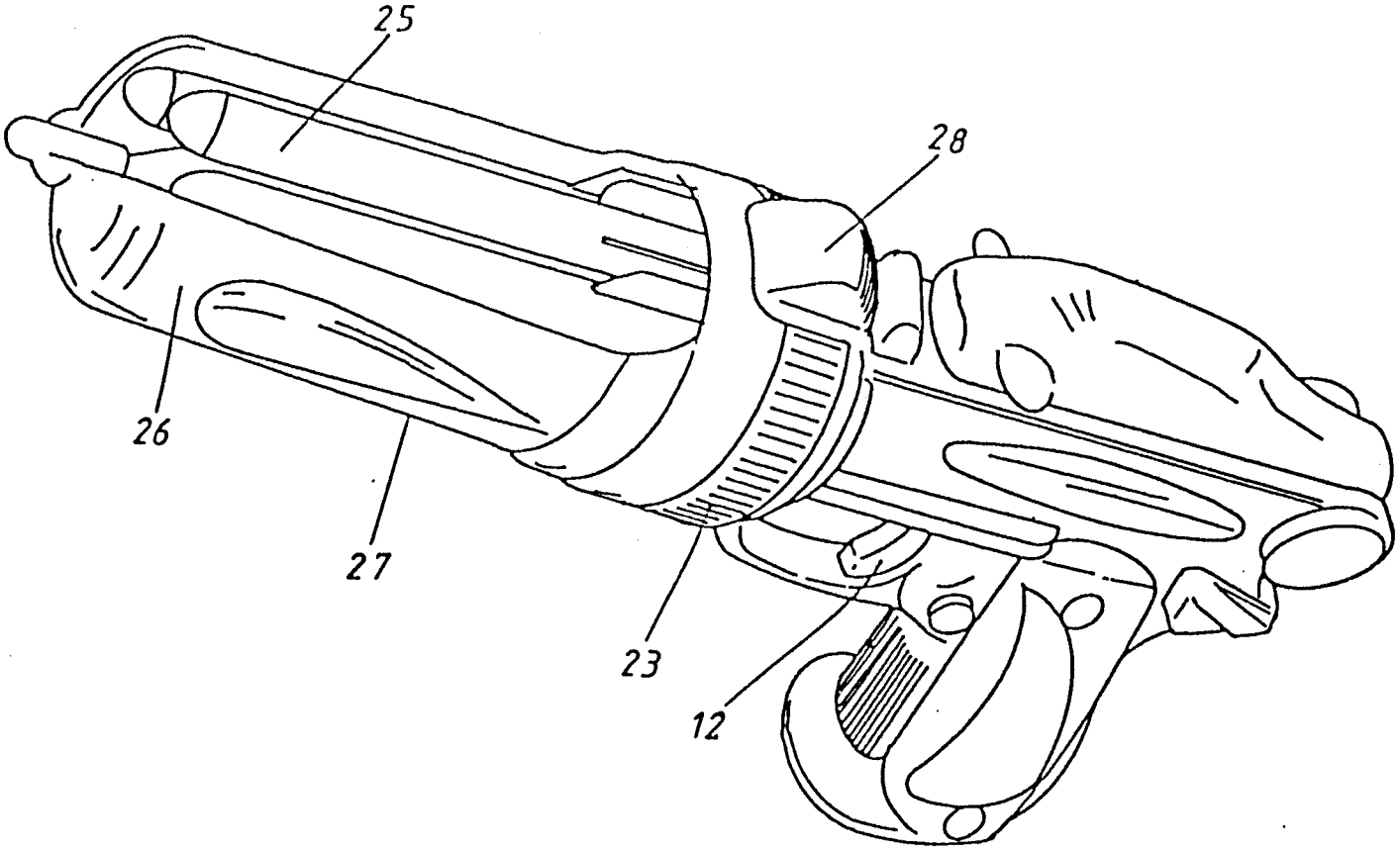
FIG. 1 is a perspective view showing an embodiment of a toy gun with a dart loading chamber according to the present invention.
Figure 2:
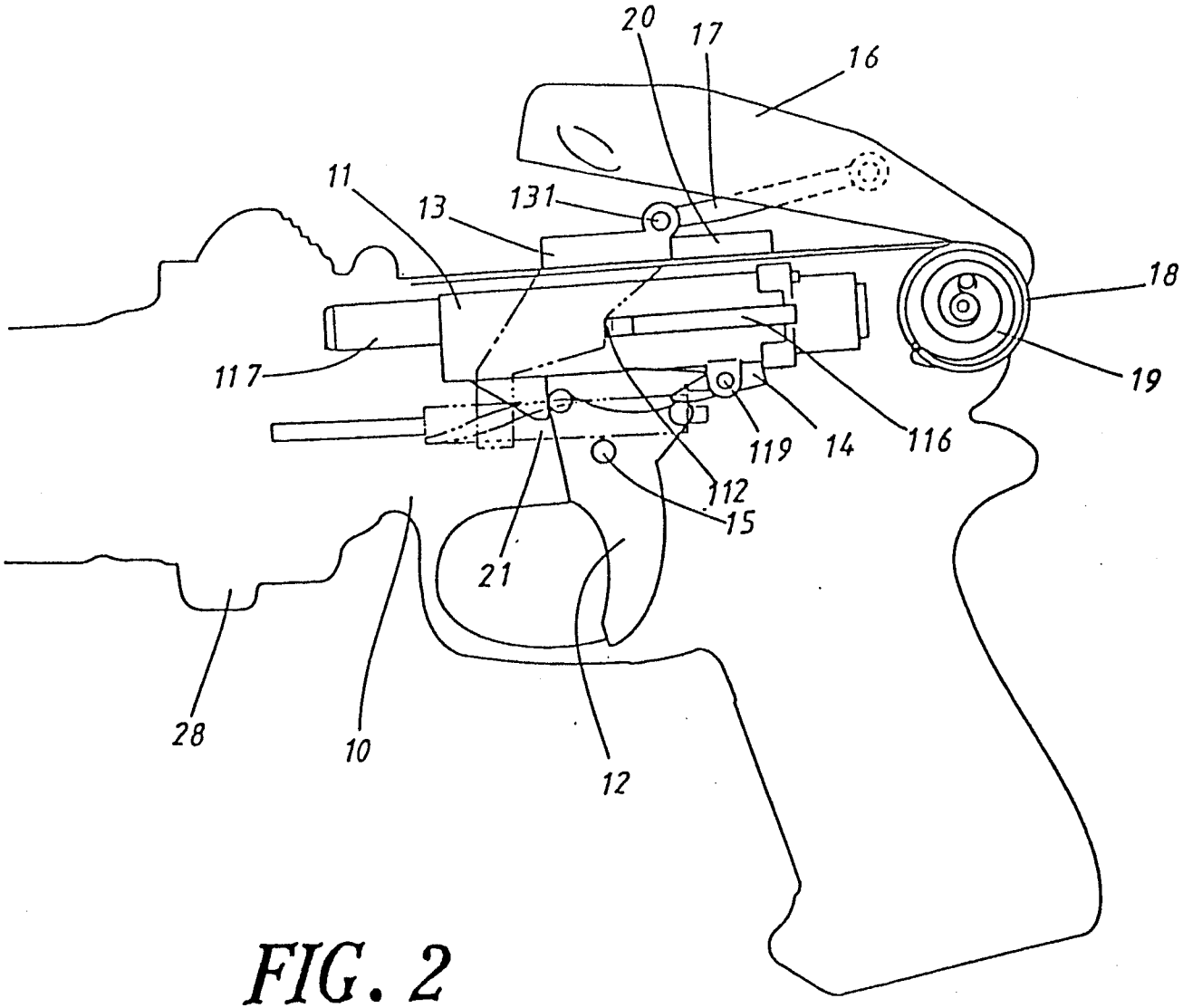
FIG. 2 is a plan view showing the internal construction of the toy gun of FIG. 1.
Figure 3:
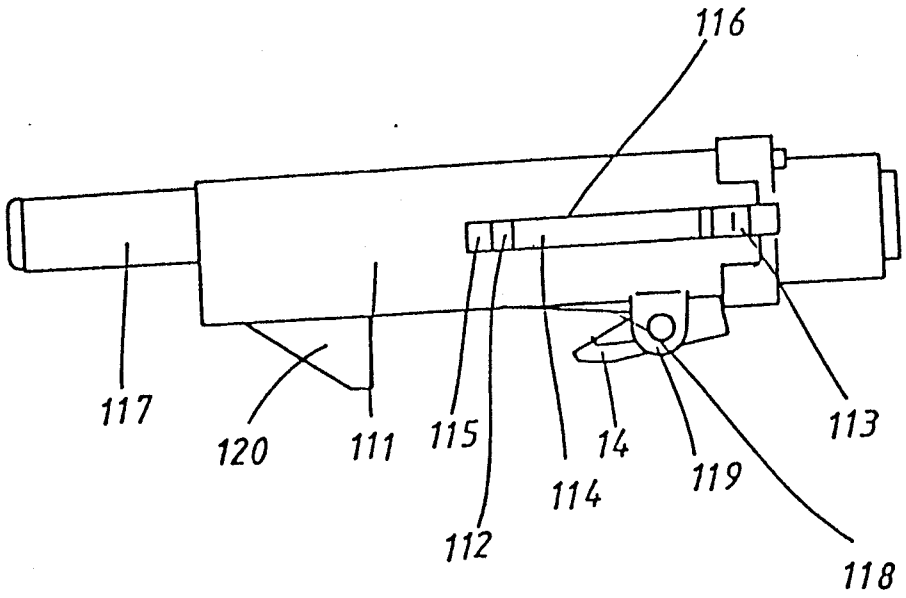
FIG. 3 shows the air compression tube of the toy gun shown in FIG. 1.
Figure 5:
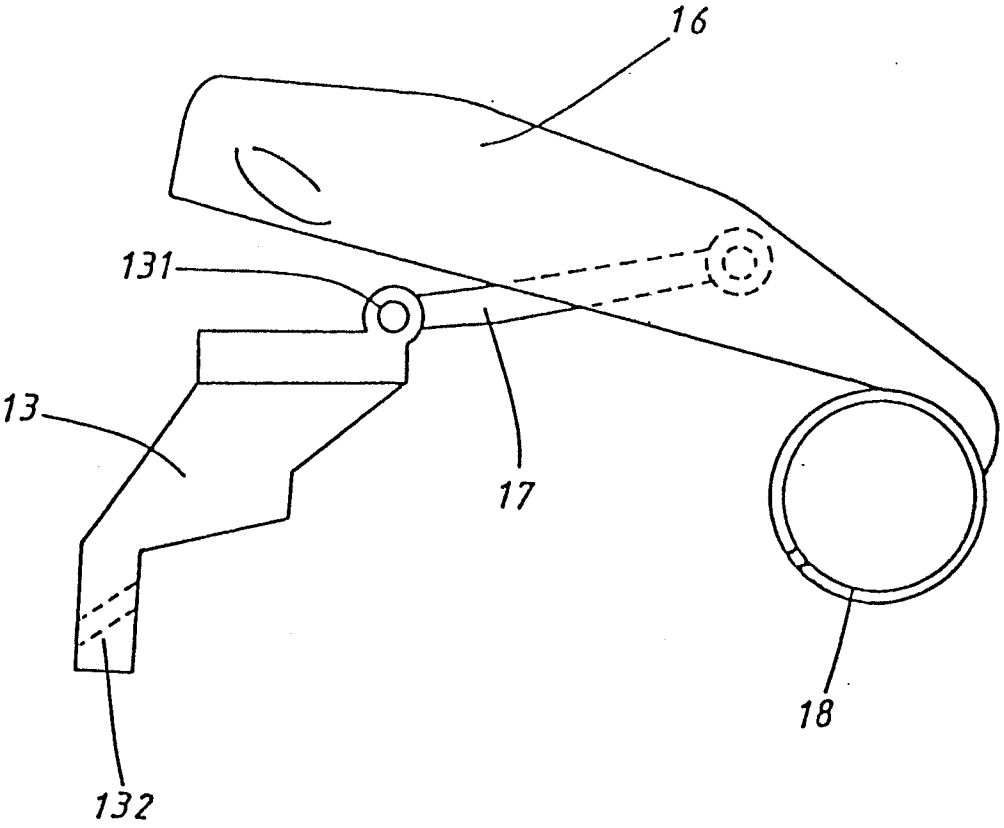
FIG. 5 shows the triggering mechanism and the pull lever of the toy gun.

FIGS. 1 and 2 are views of the embodiment of a toy gun according to this invention. FIG. 1 shows the configuration of the gun, and FIG. 2 shows the inside mechanism. The illustrated toy gun includes a gun body (10) which contains an air compression tube (11) (shown in more detail in FIG. 3), a trigger (12), and a triggering or cocking mechanism (13) fixedly secured therein. A detent member (14) and a torsion spring (118) are installed under the air compression tube (11) which as showing in FIG. 3 consists of an air cylinder (111) equipped with slide slots (116), and a piston (114) which piston has a pad (115) in on its front and a spring (113) on its back. Flanges (112) are provided on each side of the piston (114) and extend into the slide slots (116). A venting hole (117) is provided on the front end of the cylinder (111). The cocking mechanism (13) is an inverted U-shaped member which is mounted over the size of the cylinder (111), and round flanges are provided on the ends of the member, which flanges are secured in place with an anchor pin hole provided therein (not shown). A detent member (14) is connected to the fixed flanges (119) formed on the lower portion of the cylinder (111) and temporarily stopped by a torsion spring (118). The cocking mechanism (13) leans on the detent member (14), is secured on a revolving axle (15) and mates with the guide (20). Referring to the cocking mechanism and the pull lever illustrated in FIG. 5, the flanged ring (131) of the cocking mechanism (13) is pivotably connected to a pull rod (17) of a pull lever (16) which is integrally molded with the fixed round axle (18). Inside the fixed axle (18) there is installed a spring (19). The pull lever (16) is mounted on the upper portion of the gun body (10) and covers the guide (20). As it is pulled upwards and backwards, the lever (16) drives the pull rod (17). Movement of the pull rod (17) moves the cocking mechanism (13). Because the sides of the cocking mechanism (13) abut the flanges (112) on the two sides of the piston (114) as shown in FIG. 2, the backward movement of the cocking mechanism (13) moves the piston (114) backward storing energy into a spring (113), and the piston finally stops at the detent member (14). On the other hand, the energy stored in the spring inside the fixed round axle (18) during the backward displacement of the pull lever makes the lever (16) recoil to its original position covering the guide (20) on the gun body (10) and brings the toy gun to a standby status. Above is the inside construction and the operation principle of energy accumulation before launching of a dart from the toy gun according to this invention is described. Thereafter, the energy release and launchings are controlled by the trigger (12). When the trigger (12) is pressed by fingers and moves slightly upwards, it touches the flanges (120) of the piston so that the whole cylinder body (111) moves forwards and connects to the exhaust tubes (231). Consequently, the detent member (14), is pivoted by the trigger (12), and thus ceases to refrain the spring (113). The energy stored in the spring is released to move the piston (114) so as to squeeze air and make the air flow through the venting hole (117). This provides the force for launching the projectile according to the invention.

Figure 4C:
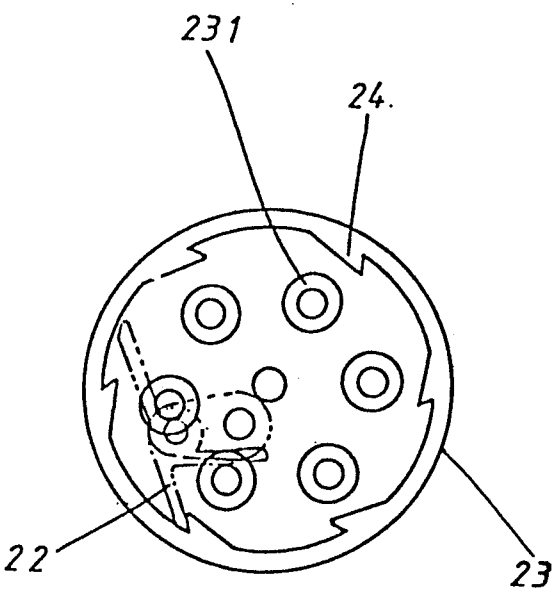
FIGS. 4A, 4B and 4C show the dart loading chamber of a rotary type, where
Figure 4B:
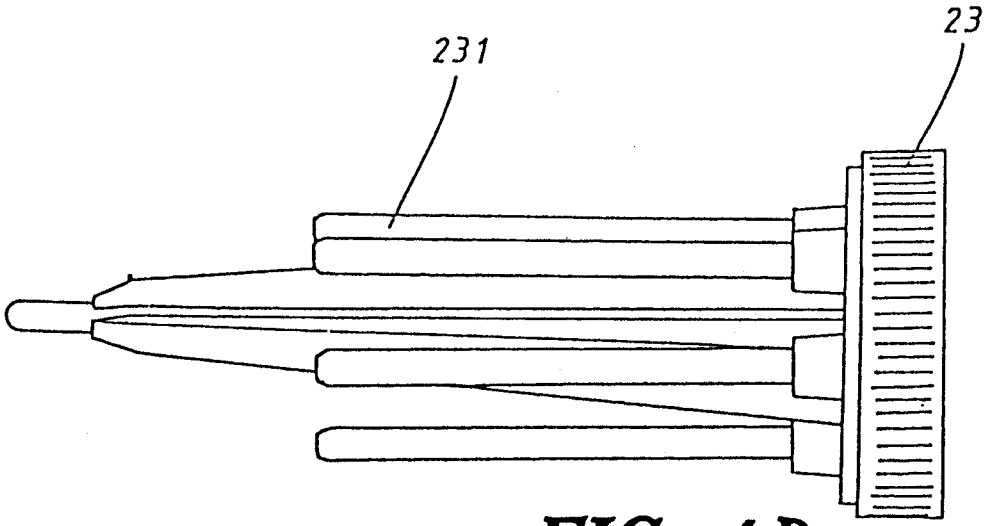
Figure 4A:
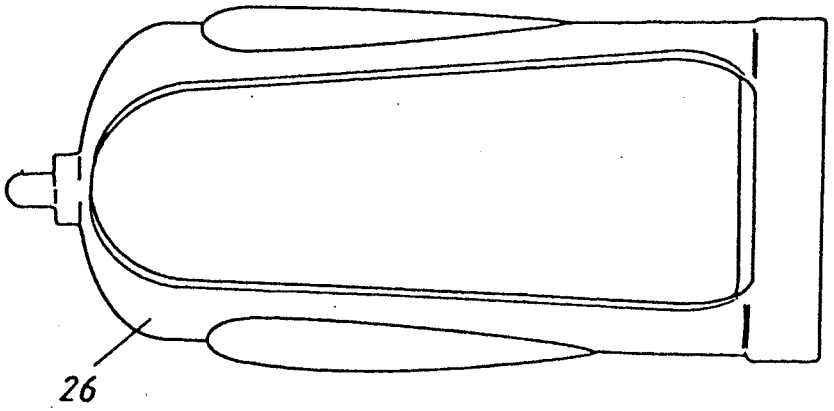

Referring to FIGS. 2, 4B, 4C and 5 now, the toy gun of this invention is provided a screw shaft (21) whose screw threads matches with the mating portion (132) of the triggering mechanism (13) which turns the screw shaft (21) in the thread direction as the triggering mechanism moves backwards. The screw shaft (21) extends to a rotary wheel (23) in front of which is arranged a turning device (22). The rotary wheel is connected to the mounting seat (28) and the turning device (22) of the rotary wheel engages with the ratchet teeth of the rotary wheel (24). That is, as the cocking mechanism (13) moves back, its mating portion (132) turns the screw shaft (21) which motion is transmitted to the turning device (22) pushing the ratchet teeth (24) of the rotary wheel, resulting in the motion of the rotary wheel (23). The rotary wheel (23) is formed by integrally molding of six exhaust tubes (231). When the trigger (13) is pushed, the venting hole (117) on the cylinder (111) moves forwards and connects to one of the six exhaust tubes (231). When the trigger (13) moves the detent member (14), the energy storage spring (113) moves the piston (114) forward so that the pad (115) forces air to blow through the venting hole (117). The air pressure is transmitted to the exhaust tubes (231). Now referring to FIG. 4 again, the exhaust tube (231) is a hollow barrel accommodating flying darts (25). After darts (25) are arranged on the exhaust tubes (231), the pressurized air in the cylinder (111) flows to the exhaust tubes (231) through the venting hole (117) and launches the darts (25). The integrally molded combination of exhaust tubes (231) and the rotary wheel (23) and a loading shell (26) constitute a dart loading chamber (27). The toy gun of this invention has the capacity of six darts and fires darts by means of the air compression principle. It is designed to have a special mechanism to turn the dart loading chamber, enabling a consecutive firing of six darts in order to promote the interest of the toy gun. The quantity of the foregoing exhaust tubes (231) may be less or more than six.

In summary, this invention provides a safe, lightweight, simplified structure of a toy gun suitable for children playing which always exhibits novelty and innovation. Because that the dart is a large projectile with remarkably color, it has higher safety. Furthermore, the toy gun of this invention does not need energy sources, such as motors, batteries, etc., and is an entirely mechanical toy. Its appearance would not be confused with the realities. It is indeed a novel and useful invention.

What is claimed is:

1. A toy gun comprising a gun body and a dart loading chamber connected to the gun body, said dart loading chamber having a rotary wheel, exhaust tubes integrally molded with said rotary wheel, a screw shaft turning said rotary wheel, and darts arranged on said exhaust tubes, and said gun body having a top containing a guide, a cocking mechanism mating with said guide, an air cylinder arranged below said top, and a trigger arranged below said air cylinder, said air cylinder having a piston with flanges and a detent member pivotally arranged at a bottom of said air cylinder for holding said piston in an energized position, said trigger abutting said detent member, said trigger pivoting said detent member when said trigger is squeezed causing said detent member to release said energized piston and launch one of said darts, said cocking mechanism having a flanged ring arranged on a top thereof and a pull rod with one end pivotally mounted on said flanged ring and another end pivotally mounted on a lever, said cocking mechanism abutting said flanges on said piston and moving said piston to said energized position when said lever is pulled, and said cocking mechanism having a mating part meshing with said screw shaft of said dart loading chamber for turning said shaft and providing another of said darts for launching when said lever is pulled.

2. The toy gun as claimed in claim 1, wherein said dart loading chamber contains a loading shell removably secured on said rotary wheel.

3. The toy gun as claimed in claim 2, wherein said rotary wheel is equipped with ratchet teeth.

4. The toy gun as claimed in claim 2, wherein said dart loading chamber contains six of said exhaust tubes.

5. The toy gun as claimed in claim 2, wherein said dart loading chamber contains either less or more than six of said exhaust tubes.

* * * * *